United States Patent [19]

Schneider

[11] Patent Number: 4,499,626

[45] Date of Patent: Feb. 19, 1985

[54] BROOM HANDLE HOLDING ATTACHMENT FOR AN INDUSTRIAL BROOM

[76] Inventor: Earl L. Schneider, Rte. 6, Box 506, Henderson, N.C. 27536

[21] Appl. No.: 544,254

[22] Filed: Oct. 21, 1983

[51] Int. Cl.[3] ..... B25G 3/24; B25G 3/38

[52] U.S. Cl. ..... 15/146; 15/150

[58] Field of Search ..... 15/145, 146, 147 C, 15/150, 176, 178, 148, 209 D, 244 R

[56] References Cited

U.S. PATENT DOCUMENTS

| | | | |
|---|---|---|---|
| 1,033,972 | 7/1912 | Westburg | 15/150 |
| 1,906,902 | 5/1933 | Firestone et al. | 15/146 X |
| 3,813,724 | 6/1974 | Unger | 15/150 |

*Primary Examiner*—Peter Feldman

*Attorney, Agent, or Firm*—Mills & Coats

[57] ABSTRACT

The present invention relates to a broom handle holding attachment that is designed to be attached transversely across an elongated bristle holder of an industrial type broom. The broom handle holding attachment is designed to receive a broom handle and is further designed to clamp transversely across an elongated bristle holder. To secure the broom handle holding attachment across the bristle, the same is provided with an over-center latching mechanism that is interconnected between two arm assemblies. The arm assemblies are adapted to attach across opposite sides of said bristle holder and by actuating the over-center latching mechanism, the arm assemblies are securely fastened transversely across the bristle holder.

7 Claims, 3 Drawing Figures

BROOM HANDLE HOLDING ATTACHMENT FOR AN INDUSTRIAL BROOM

FIELD OF INVENTION

The present invention relates to brooms, and more particularly to a broom handle receiving attachment that is detachably connected to a bristle holding member.

BACKGROUND OF INVENTION

Industrial type brooms include an elongated bristle holder with bristles depending therefrom. An opening is formed in the top of said bristle holder for receiving an elongated handle.

It is not uncommon for the handle of such a broom to break in the vicinity of the opening formed within the bristle holder. Ofter when this occurs a portion of the handle extending into the bristle holder cannot be removed without damaging the opening within the bristle holder to such a degree that it is no longer suited for receiving a new handle. When this happens, the entire broom has to be discarded, even though the base of the broom, that is the bristle holder and bristles thereof, are still in very good condition.

Obviously this is wasteful and expensive to a firm that utilizies such brooms to maintain their facilities.

Because of the nature of such broom designs, broom handles are going to continue to break and often the break is going to occur in the vicinity of the opening formed within the bristle holder. What is needed, is some means that will enable one to continue to use the base of the broom such that the individual will not be required to purchase a new broom after each such instance.

SUMMARY AND OBJECTS OF INVENTION

The present invention entails a broom handle receiving attachment that is designed to be secured transversely across a bristle holder. The broom handle attaching device includes a handle receiver that is readily adapted to receive an elongated broom handle. In addition, the broom handle attaching device includes an over-center latching mechanism operatively interconnected between two arm assemblies. The arm assemblies are adapted to extend transversely over, in a bridging fashion, the bristle holder. By actuating the over-center latching mechanism, the arm assemblies are drawn so as to secure said broom handle receiving attachment securely to said bristle holder.

Therefore, it is appreciated that if the broom handle breaks that the same can be readily exchanged with respect to the broom handle receiving attachment without causing any complications with the bristle holder.

It is therefore an object of the present invention to provide a broom handle receiving attachment that is readily attachable and detachable with respect to the bristle holder of the broom.

A further object of the present invention resides in the provision of a broom handle receiving attachment that is adapted to be interconnected between a broom's bristle holder and a broom handle such that in the event that the handle breaks, a new handle can be inserted into the handle receiving attachment.

Further, it is an object of the present invention to provide an apparatus for use in conjunction with a commercial or industrial type broom that effectively prevents one from having to completely discard the entire broom in the event that a handle breaks adjacent the base or bristle holder of the broom.

A further object of the present invention resides in the provision of a broom handle attachment of the character referred to above that can be easily and conveniently attached and detached to the bristle holder of a broom.

Another object of the present invention resides in the provision of a broom handle attachment of the character referred to above that includes an over-center latching mechanism for enabling said broom handle attachment to be quickly and easily attached and detached with respect to the broom's bristle holder.

It is also an object of the present invention to provide a broom handle attachment of the character referred to above that is designed such that once the same assumes an attached posture that it is secured and firmly supported on the broom's bristle holder and will not tend to slide and come unfastened when the broom is used for sweeping.

It is also an object of the present invention to provide a broom handle receiving attachment of the character referred to above that is designed to conveniently receive and accept a broom handle and wherein the same is especially designed such that a broken end portion of the broom handle can be easily and readily removed therefrom without a great deal of time and effort.

Other objects and advantages of the present invention will become apparent from a study of the following description and the accompanying drawings which are merely illustrative of the present invention.

DETAILED DESCRIPTION OF THE PREFERRED EMBODIMENT

With further reference to the drawings, the broom handle receiving attachment of the present invention is shown therein and indicated generally by the numeral 10.

Figure 2:
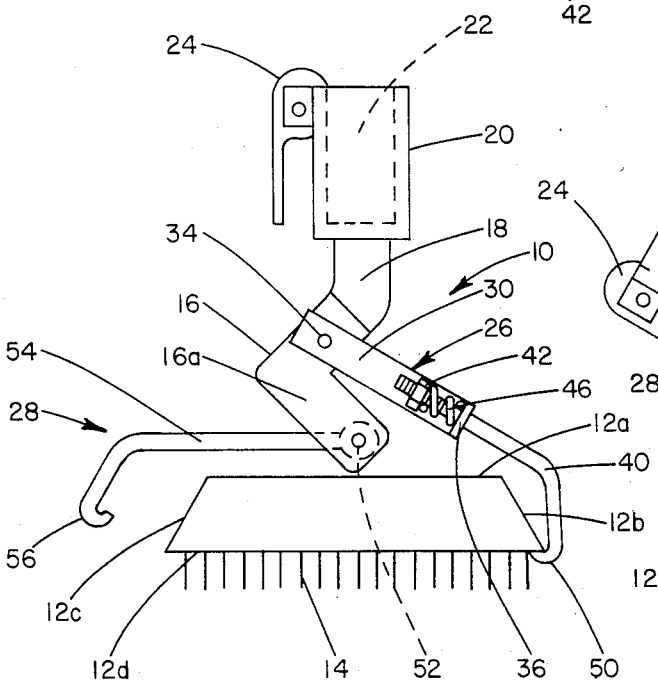
FIG. 2 is a side elevational view of the broom handle receiving attachment shown in the open unattached position.
Figure 3:
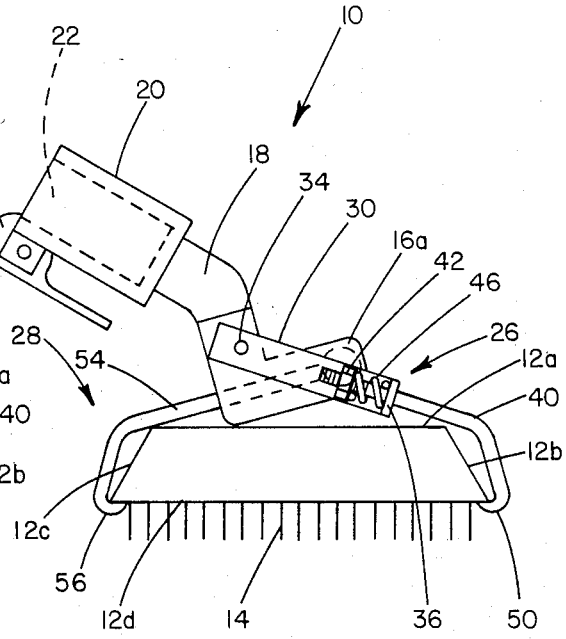
FIG. 3 is a side elevational view illustrating the broom handle receiving attachment in a closed position where the same is firmly secured transversely across a broom's bristle holder.

The broom handle receiving handle attachment is particularly designed to be attached to the base protion of an industrial type broom of the type having an elongated bristle holder 12 with an array or plurality of bristles 14 secured thereto and depending downwardly therefrom, as illustrated in FIGS. 2 and 3.

Basically, the broom handle receiving attachment 10 of the present invention includes an over-center latch mechanism operatively interconnected between first and second arm assemblies 26 and 28 respectively. The over-center latching mechanism comprises a bell crank 16. Bell crank 16 includes two laterally spaced apart L-shaped plates **16*a* and 16*b***.

Secured to a portion of bell crank 16 is an extension 18. Extension 18 has secured thereto a handle receiver 20. Handle receiver 20 includes a cylindrical opening 22 formed therein for receiving a broom handle 58. It is appreciated that various means can be employed to securely hold broom handle 58 within handle receiver 20. In the present disclosure there is provided a wedging device 24 rotatively mounted adjacent the upper end of handle receiver 30. Once the broom handle 58 is inserted within opening 22, it is seen that wedging device 24 can be pivoted clockwise, as viewed in FIGS. 2 and 3. This clockwise movement of wedging device 24 results in the same engaging a portion of broom handle 58 and effectively wedging and securing the same within handle receiver 20.

Figure 1:
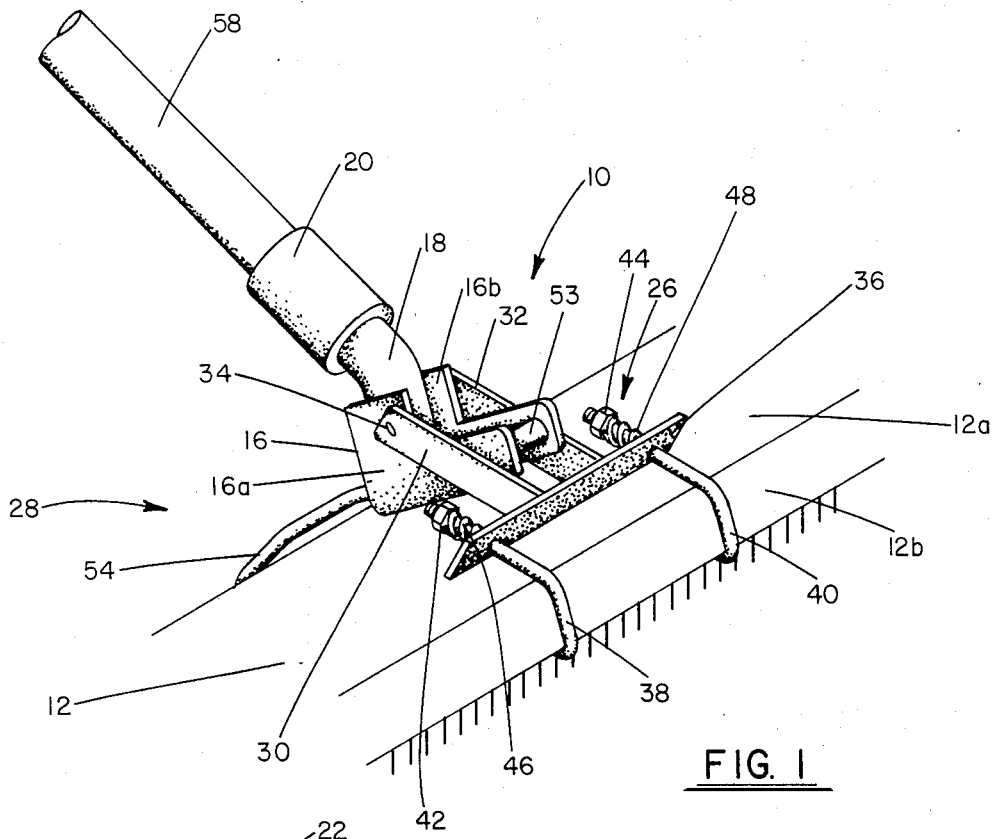
FIG. 1 is a perspective view of the broom handle receiving attachment of the present invention shown secured transversely across a broom bristle holder.

Connected to bell crank 16 is the pair of arm assemblies 26 and 28, previously referred to herein. First, arm assembly 26 is designed to be extendable and as such comprises two sections that are movable with respect to each other. Viewing first arm assembly 26 in more detail, the same includes a pair of laterally spaced links 30 and 32 having one end pivotly mounted to respective plates 16*a* and 16*b* of bell crank 16 by pivot pins 34, as particularly illustrated in FIG. 1. Pivot pins 34 form a first axis and it is appreciated that the links 30 and 32 may rotate thereabout with respect to bell crank 16.

About the end of links 30 and 32 opposite pivot pins 34, there is provided a T-bar 36. T-bar 36 includes a pair of laterally spaced openings. Extending through and confined within the pair of openings within T-bar 36 is a pair of securing hooks 38 and 40. Hooks 38 and 40 include a threaded end and secured about each threaded end is a stop nut 42 and 44. From the drawings, it is appreciated that there is defined a space between respective stop nuts 42 and 44 and T-bar 36.

Disposed between stop nuts 42 and 44 and T-bar 36 is springs 46 and 48 that tend to bias the respective hooks 38 and 40 towards bell crank 16.

The remote ends of hooks 38 and 40 are formed into hook shaped ends 50.

Turning to second arm assembly 28, it is seen that the same is secured about a shaft 52 that extends transversely between plates 16*a* and 16*b* of bell crank 16. This shaft forms the pivot axis of a hook 54 that is secured to a collar 53 that is in turn rotatively journaled about shaft 52. Consequently, it is appreciated that second arm 28 and the hook 54 thereof is pivotly connected to bell crank 16.

About the remote end of hook 54, it is seen that there is formed into a hook shaped portion 56.

In operation, the broom handle receiving attachment 10 can be moved between an open position (FIG. 2) and a closed secured position (FIG. 3). In an open position, bell crank 16 extends between arm assemblies 26 and 28. In this open position, broom handle receiving attachment 10 can be placed transversely across a broom's bristle holder 12 as illustrated in FIG. 2. To secure broom handle receiving attachment 10 to bristle holder 12, first arm 26 is hooked underneath an edge portion of the bottom 12*d* of bristle holder 12. Next, bell crank 16 is generally pivoted counterclockwise about axis 24 causing second arm assembly 28 to be drawn towards the opposite side of bristle holder 12. As bell crank 16 is continued to be rotated, it is appreciated that the hook end 56 of hook 54 can be munipulated so as to engage a bottom edge portion of bristle holder 12. Bell crank 16 is continued to be rotated counterclockwise until it assumes a position such as illustrated in FIG. 3. In this position, the pivot axis of hook 54 has passed "over-center" and the broom handle receiving attachment assumes a firm latched position and as such is secured transversely across bristle holder 12.

Next, a broom handle 58 can be inserted into opening 22 of broom handle receiving 20. By actuating said wedging device 24, broom handle 58 can be wedged and securely held within broom handle receiver 20.

Should it become necessary to remove broom handle receiving attachment 10 from bristle holder 12, then this can be done easily and conveniently. In the closed or secured position, illustrated in FIG. 3, it is appreciated that spring 46 and 48 are under a certain degree of compression but are not completely compressed. To remove broom handle receiving attachment 10, the first arm assembly 26 can be engaged and extended by pulling the lower hook ends 50 downwardly and way from the bottom edge of bristle holder 12. It is appreciated that this can be done because of the presence of springs 46 and 48. Once this is done, the bell crank 16 can be pivoted generally clockwise about the pivot axis of shaft 52, as particularly illustrated in FIG. 2. The rotation of bell crank 16 clockwise acts to detach the entire broom receiving handle attachment 10 from the broom bristle holder 12.

Therefore, it is appreciated that bell crank 16 acts as an over-center latching mechanism. Also in moving between the open and closed position as illustrated in FIGS. 2 and 3 respectively, it is seen that the respective pivot axes of the respective arm assemblies 26 and 28 pass over and under each other, and effectively exchange sides.

From the foregoing specification and discussion, it is appreciated that the broom handle receiving attachment of the present invention enables broken broom handles to be replaced in a broom assembly without the base portion or bristle holder of the broom being discarded. In the event that a handle breaks and even if the handle breaks near or in handle receiver 20, the same can be conveniently removed even if drilling is required. After removing the broken portion of the broom handle, then the new broom handle can be inserted in broom handle receiver 20.

The present invention, may of course, be carries out in other specific ways than those herein set forth without departing from the spirit and essential characteristics of the invention. The present embodiments are, therefore, to be considered in all respects as illustrative and not restrictive and all changes coming within the meaning and equivalency range of the appended Claim are intended to be embraced therein.

What is claimed is:

1. A broom handle receiver and holder adapted to be readily attached transversely across an elongated bristle holder of a broom, said broom handle receiver and holder comprising: an over-center latching broom handle receiving and holding clamp having first and second arm means for engaging opposite side portions of an elongated bristle holder of a broom; at least one of said arm means being extensible from a contracted position to an extended position and including biasing means for biasing said extensible arm means towards said contracted position; said extensible arm means further including a pair of hook members with each hook member including a hook shaped terminal end portion for engaging and grasping said bristle holder; said biasing means including a spring disposed about a portion of each hook member and is confined by a first stop means fixed to the respective hook member and a second stop means disposed adjacent said hook member but not constrained to move with said hook member in order that said hook member may move relative to said second stop means; an over-center latch pivotly mounted to said first and second arm means and operatively interconnected therebetween, said over-center latch being movable relative to said first and second arm means between a first open position where said arm means assume an expanded non-attached position and a second over-center latch position where said arm means assumes a contracted position and grip the sides of said bristle holder so as to secure said broom handle receiving means secured on said broom handle receiving and holding clamp for receiving a broom handle.

2. The broom handle receiver and holder of claim 1 wherein said over-center latch means comprises a bell crank and wherein said bell crank includes two pivot axes with each pivot axis being connected to a respective arm means.

3. The broom handle receiver and holder of claim 1 wherein said broom handle receiving means includes a cylindrical pipe like member that extends from said bell crank.

4. The broom handle receiver and holder of claim 3 wherein said cylindrical pipe like member that includes means for engaging a broom handle for securing the same within the said cylindrical pipe like member.

5. The broom handle receiver and holder of claim 1 wherein said extensible arm means further includes a T-shaped member that extends from said over-center latch and is operatively coupled to said hook members, and wherein said T-shaped member includes a pair of laterally spaced links that are pivotly connected to said over-center latch and a transverse T-bar secured to the ends of said links opposite the pivotable connection with said over-center latch and wherein said transverse T-bar includes openings formed therein for receiving each of said hook members and werein said transverse T-bar forms said second stop means such that said springs tend to force said hook members to a contracted position by engaging and exerting a force against said first stop means secured to said respective hook members.

6. The broom handle receiver and holder of claim 1 wherein only one of said arm means is extensible and wherein said other arm means includes a hook member including an outer terminal end portions that is shaped in the form of a hook for engaging and grasping a portion of said bristle holder.

7. A broom handle attachment for coupling a broom handle to an elongated broom bristle holder comprising: an over-center latching mechanism interconnecting first and second arm assemblies wherein said over-center latching mechanism and said first and second arm assemblies are designed to extend transversely across a broom bristle holder and wherein said over-center latching mechanism is operative to latch and secure said arm assemblies across said bristle holder; said first arm assembly being pivotly connected to said over-center latching mechanism about a first axis and including extensible first and second sections wherein said first and second sections are coupled together by biasing means such that said first and second sections can be moved from a contracted position to an extended position and wherein said biasing means tend to urge said first and second sections towards said contracted positions; said extensible first arm assembly further including means for engaging and grasping a portion of said bristle holders; said second arm assembly being pivotly connected to said over-center latching mechanism about a second pivot axis that extends parallel to said first pivot axis and wherein said second arm assembly includes means for engaging and grasping a portion of said bristle holder, said over-center latching mechanism including a bell crank including two spaced apart plates and wherein one of said arm assemblies is pivotly connected between said plates while said other arm assembly is pivotly connected between said plates while said other arm assembly is pivotly connected outside of said plates; a broom handle receiver extending from said over-center latching mechanism for receiving a broom handle; said over-center latching mechanism being movable from an open position to a closed position and wherein in said open position said first and second arm assemblies assume an open position that may be conveniently placed transversely across said broom bristle holder and in said closed position said first and second arm assemblies assume a closed grasping position wherein said arm assemblies are secured transversely across said bristle holder such that said broom handle holding device is secured directly to said bristle holder; and wherein in said open position said first and second pivot axes assume spaced apart positions with said first axis being on one side and said second axis being on the other side and wherein when moving from said open position to said closed position said first and second pivot axes move one over the other to where the first axis assumes a position on said other side while second axis assumes a position on said one side, and wherein in said closed position said over-center latching mechanism assumes a latched posture.

* * * * *